United States Patent [19]

Kreill

[11] Patent Number: 4,957,475

[45] Date of Patent: Sep. 18, 1990

[54] SOLID-BOWL HELICAL CENTRIFUGE

[75] Inventor: Walter Kreill, Vilsbiburg, Fed. Rep. of Germany

[73] Assignee: Flottweg GmbH, Vilsbiburg, Fed. Rep. of Germany

[21] Appl. No.: 347,758

[22] Filed: May 4, 1989

[30] Foreign Application Priority Data

May 11, 1988 [DE] Fed. Rep. of Germany ..... 3816210

[51] Int. Cl.[5] ..... B04B 1/20

[52] U.S. Cl. ..... 494/53; 494/83

[58] Field of Search ..... 494/53, 54, 52, 55, 494/83; 210/781, 782

[56] References Cited

U.S. PATENT DOCUMENTS 3,172,851 3/1965 Ambler ..... 494/53
3,379,368 4/1968 Gilreath ..... 494/54
3,854,658 12/1974 Helmuth ..... 494/53
4,142,669 3/1979 Burlet ..... 494/53
4,509,942 4/1985 Gunnewig ..... 494/53

*Primary Examiner*—Robert W. Jenkins
*Attorney, Agent, or Firm*—Max Fogiel

[57] ABSTRACT

Solid-bowl helical centrifuge for separating a suspension, with a stationarily secured intake pipe (31) for supplying the suspension from a stationary infeed point outside the centrifuge to a separation space (3) left between the screw (2) and the bowl (1), whereby, to prevent obstructions due to centrifugal force and malfunctions due to radial displacements and ensure low-maintenance operation, the intake pipe (31) extends into an intake space (32) inside the screw and the end (34) at that location rests against a component (36 and 35, 36 and 38, 36, or 43), which is secured to the screw, by way of a friction bearing (12) with two halves (14 and 15) that are made of a ceramic material where they contact each other.

13 Claims, 4 Drawing Sheets

SOLID-BOWL HELICAL CENTRIFUGE

Figure 1:
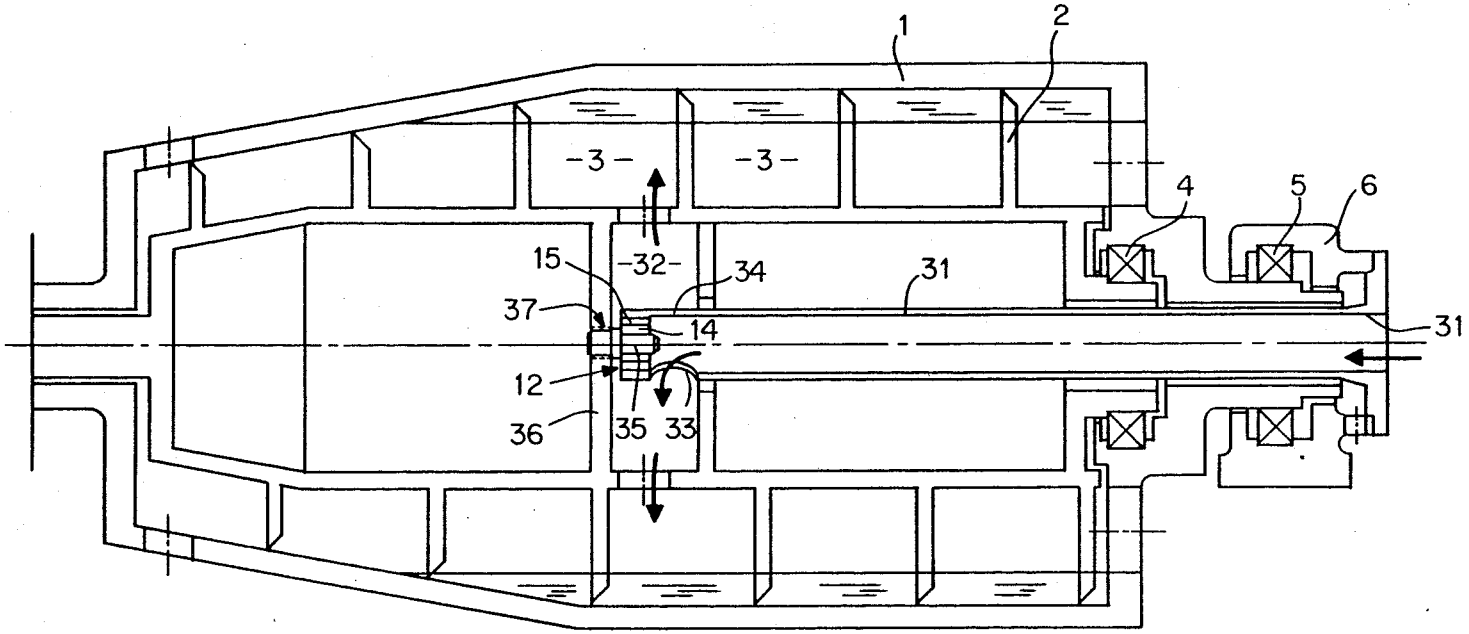

The invention concerns a solid-bowl helical centrifuge with the characteristics recited in claim 1.

Centrifuges of this type are employed to separate suspensions into a solid phase and at least one liquid phase subject to centrifugal force. The suspensions can have several different components. They may contain chemically aggressive materials and/or particles, sand for example, that occasion considerable wear. It is accordingly always attempted to ensure that the lines that supply the suspensions extend as continuously as possible all the way into the centrifuge's separation space or into a distributor space that opens into the separation space inside the core of the screw. Some of the pipes are accordingly very long, which occasions problems in securing them and in preventing them from extensively vibrating radially. This situation occurs in particular in centrifuges of the aforesaid type that operate on what is called the counterflow principle, whereby the suspension enters the separation space far inside the centrifuge. Although providing a bearing for such a long and stationary intake pipe where it ends inside the core of the screw would eliminate these problems, a bearing inside the core is more exposed to contamination, and access for maintenance is very difficult.

The object of the present invention is to supply the suspension as far as possible by way of a stationary intake pipe up to its entry into the separation space even when the intake into the separation space is very far away from the supply surface of the centrifuge's bowl at the longitudinal midpoint of the centrifuge and beyond, as it is in countercurrent centrifuges, without the resultingly long and stationary intake pipe causing operational malfunctions due to wide radial displacements and without necessitating expensive and time-consuming repair and/or maintenance.

With a solid-bowl helical centrifuge having the characteristics recited in the preamble to claim 1 as a point of departure, this object is attained in accordance with the invention by the characteristics recited in the body of the claim.

The aforesaid long intake pipe, extending into an intake space inside the screw that opens directly into the separation space through radial openings, is supported at the end that faces the intake space by a friction bearing on a section of the screw that is secured to or in one piece with the main section of the screw, thus preventing disruptive radial displacements. The friction bearing is accordingly positioned far inside the centrifuge screw, and the sections of the two halves of the bearing that are exposed to friction are made of a ceramic material. Although the sections of the ceramic halves that are exposed to friction are in contact with the suspension, there will be no problem in relation to wear and/or maintenance because ceramic materials of this type are extremely resistant to abrasion and corrosion, and a centrifuge with a friction bearing that has ceramic materials in the section exposed to friction can be reliably and permanently employed even for suspensions that have wear-producing and corrosive properties. Friction bearings of this type stand up to high speeds and to the buildup of pressure that can occur beyond the separation space in conjunction with certain bearing systems.

Several ceramic materials can be employed, with one or another, $Si_3N_4$, $Al_2O_3$, MgO, or $ZrO_2$ for example, being preferred for a particular purpose or suspension.

Oxide-free ceramics, preferably SiC and specifically sintered, are preferably employed, however, resulting in pure silicon carbide with no free percentage of silicon.

It is basically possible to secure the radially outer half of the friction bearing to one of the face-demarcating surface of the intake space inside the core of the screw and the radially inner half to the outer surface of the stationary or stationarily secured intake pipe. It is also possible to secure the radially inner half of the friction bearing to a bolt, even a hollow bolt, secured to the face-demarcating surface of the intake space and the radially outer half to the terminating edge of the end of the stationary intake pipe or to an expansion of that end. The end of the intake pipe can also rest indirectly, by way of another concentric pipe inside it for example, on a partition in the main section of the screw.

Measures are taken in accordance with another preferred embodiment to create a hydrodynamic lubricating film between the surfaces of the halves of the friction bearing that slide against each other due to the presence of a liquid medium.

This situation will in particular occur if the friction bearing communicates with the inside of the intake pipe and is lubricated by the centrifugate that enters the centrifuge's separation space through the intake pipe. It is, however, also possible to provide a backup liquid for lubricating the friction bearing that is automatically supplied when the supply of centrifugate is interrupted. It is in particular possible to provide a separate line to supply lubricant to the friction bearing. The temperature of the friction bearing can also be monitored by temperature sensors and the supply of lubricant to it be automatically initiated or the centrifuge turned off when the temperature exceeds a certain threshold.

The main section of the screw, in a conical section of the centrifuge that removes the solids from the bottom of the separation space, can accommodate a space for introducing rinse, whereby the friction bearing can simultaneously function as a seal at the transition between a stationary intake line for the rinse and the rotating main section of the screw. In this situation, whereby a rinse-supply pipe rests against the bearing on the main section of the core of the screw, the intake pipe rests against the rinse-supply pipe, and the end of the intake pipe can rest indirectly on the core by way of the friction bearing.

In an especially preferred embodiment, care can be taken to ensure that the ceramic bearing can easily be inspected inside the screw, in the vicinity, that is, of the intake space into the screw, without dismantling the centrifuge.

When the ceramic friction bearing slides over a film of lubricant that is replenished from the introduced suspension, care is taken in one preferred embodiment to ensure that the film will be maintained by another lubricant while the suspension is not being supplied.

Figure 2:
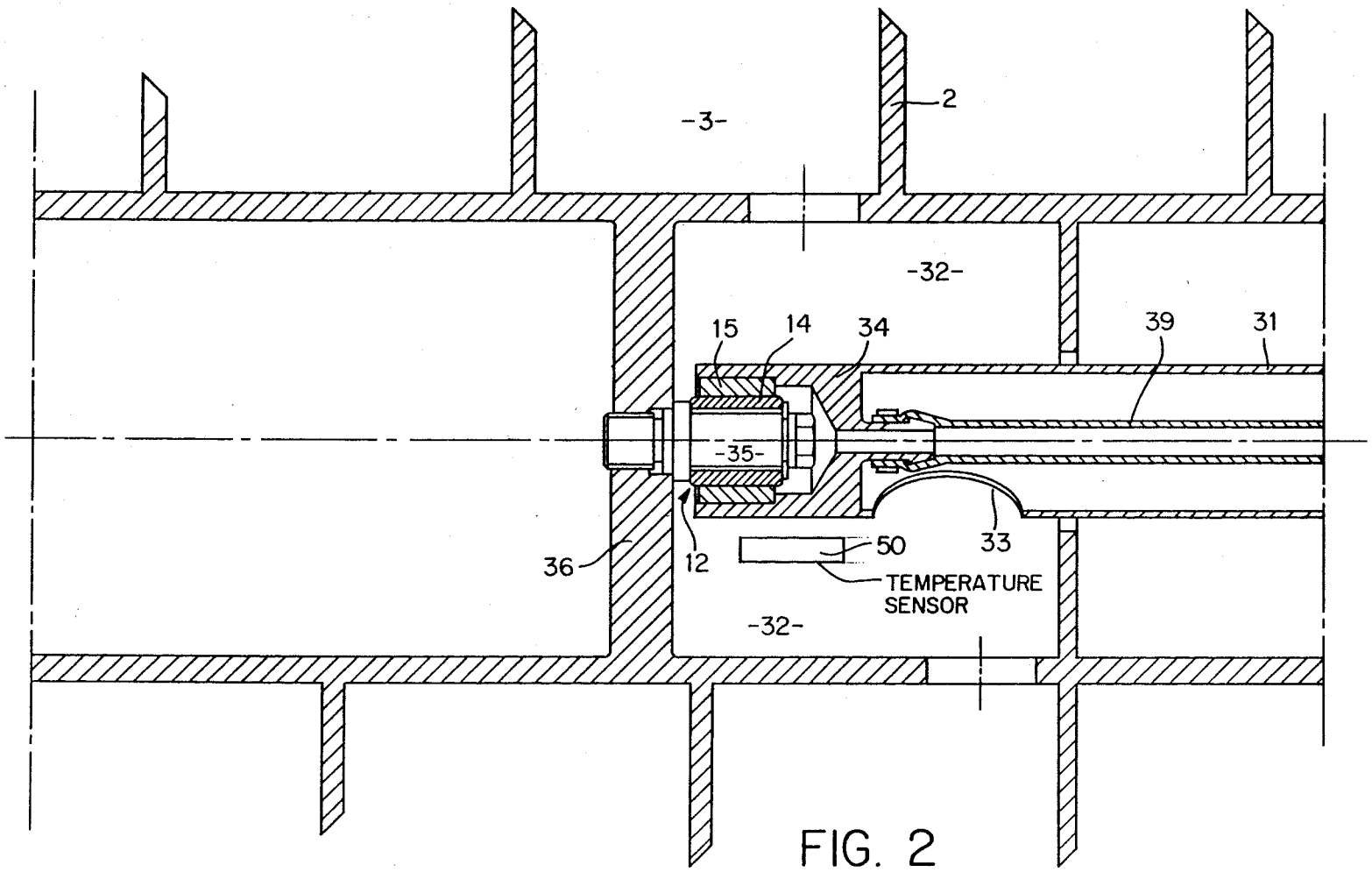
Figure 3:
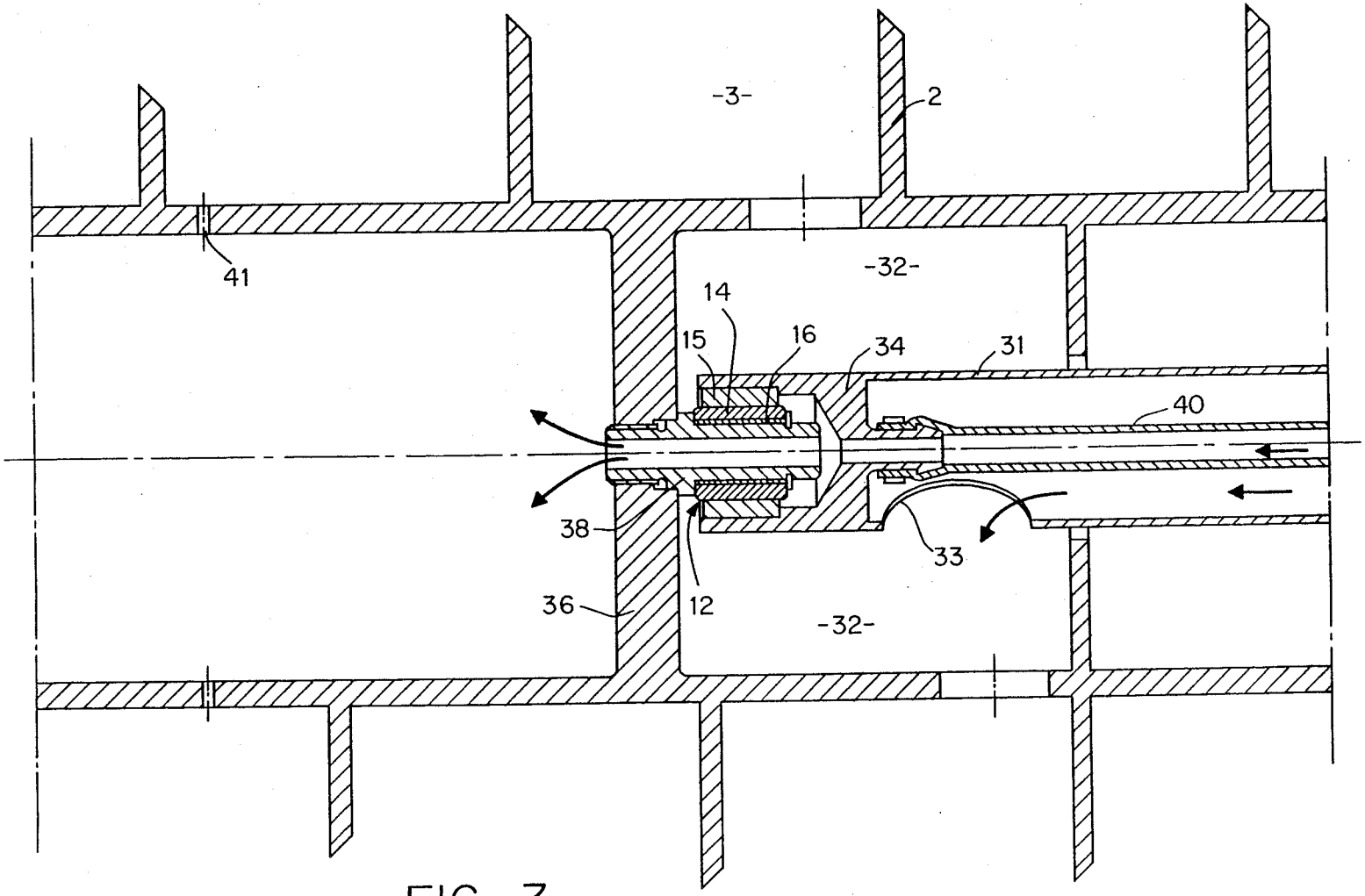
Figure 4:
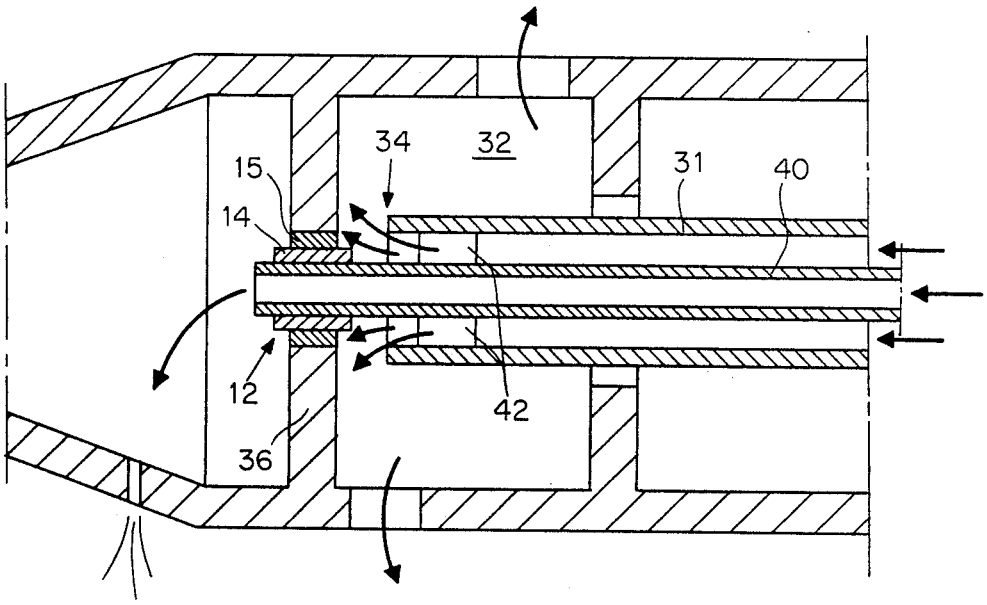
Figure 5:
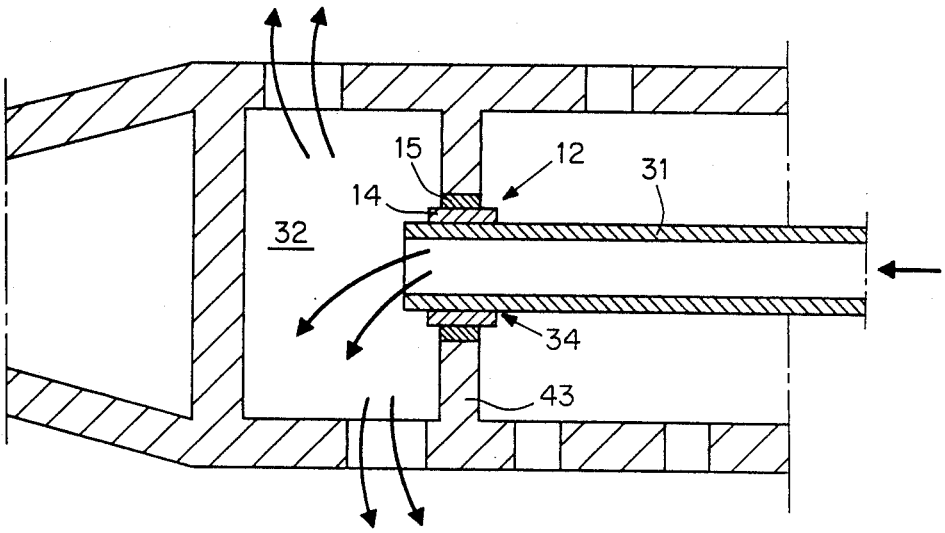

These and other preferred embodiments of the invention will be evident by way of example from the subsidiary claim, especially in conjunction with the examples illustrated in the drawing, which will not be described in greater detail, whereby FIG. 1 is a schematic section through a solidbowl helical centrifuge in accordance with one embodiment, FIG. 2 is a larger-scale partly sectional detail of the area of the screw in the vicinity of the intake space in accordance with another embodiment, FIG. 3 is a section like that in FIG. 2 through a third embodiment, FIG. 4 is a section like that in FIG. 2 through a fourth embodiment, and FIG. 5 is a section like that in FIG. 2 through a fifth embodiment.

Of the first embodiment of the solid-bowl helical centrifuge, only the face or bearing at the end where the suspension enters and the separation space 3 left between a bowl 1 and a screw 2 in the intake area are illustrated. Screw 2 is secured to the bowl at point 4 and the bowl to a stationary component 6, which functions in this case as a bearing block, at point 5. Only the vicinity of the intake space inside the centrifuge in the embodiment illustrated in FIG. 1 is illustrated, in a larger scale, in the other figures.

An intake pipe 31 for supplying the suspension extends in the form of a stationary pipe into an intake space 32 from an unillustrated stationary suspension-feed point off the right of FIG. 1. The end 34 of intake pipe 31 inside intake space 32 rests against a bolt 35 accommodated in a bore 37 in the surface 36 that demarcates the face of the space. Accommodated radially between bolt 35 and the inner surface of the end 34 of long and stationary intake pipe 31 is a friction bearing 12 comprising two halves 14 and 15, preventing radial displacements of the end 34 of intake pipe 31 in relation to bolt 35. The suspension enters long intake pipe 31 in the direction indicated by the arrow on the right and leaves it through an outlet opening 33 that communicates with the intake space 32 in screw 2, whence the suspension conventionally arrives in separation space 3 through openings in the core of the screw. Due to the supply of suspension from intake pipe 31 and its residence in the intake space 32 inside screw 2, friction bearing 12 is bathed in suspension from both ends. The suspension creates a hydrodynamic film of lubricant for friction bearing 12, the operating surfaces of which are exposed to stress from the suspension. The two halves 14 and 15 of friction bearing 12, which slide against each other, are made of a ceramic material, particularly silicon carbide, so that abrasion and friction phenomena due to the grinding action of the suspension solids occur only slightly if at all.

The intake pipe 31 in the embodiment illustrated in FIG. 1 can be assembled with friction bearing 12 and bolt 35 and inserted parallel with the length of the pipe from outside the device, preassembled to that extent, into the illustrated position, whereby bolt 35 engages bore 37 in some way such that they cannot rotate in relation to each other. Partial disassembly in the reverse order will easily allow the bearing to be inspected or replaced without having to take the whole centrifuge apart.

The end 34 of the intake pipe 31 illustrated in FIG. 2 is mounted on a bolt 35 in the same way as in FIG. 1, although there is also a hexagon that allows bearing half 14 to be removed from the bolt.

Backup lubricant is supplied to the embodiment illustrated in FIG. 2 through a line 39 in the event that the supply of suspension is interrupted. Whereas accordingly the suspension entering intake space 32 through outlet opening 33 ensures the creation of a hydrodynamic lubricating film between halves 14 and 15 no farther downstream than the end remote from the intake, a supply of similar lubricant will continue to maintain the hydrodynamic film between halves 14 and 15 when the supply of suspension through line 39 is interrupted.

One or more temperature sensors 50 can be provided in the vicinity of the friction bearing to automatically initiate the supply of backup lubricant to the bearing when its temperature. It is of course also possible to provide an emergency turn-off for the centrifuge.

The end 34 of the intake pipe 31 in the embodiment illustrated in FIG. 3 rests against friction bearing 12 or its halves 14 and 15 as in the embodiment illustrated in FIG. 2, although the bolt, to which inner bearing half 14 is secured by a compensation structure 16 for example, is a hollow bolt 38 with a bore that extends through it axially. The opening in the continuous bore that faces the intake end is oriented toward an intake like that for the emergency lubricant in FIG. 2 but supplying rinse in the embodiment illustrated in FIG. 3 to ensure that friction bearing 12 will be supplied with lubricant while simultaneously supplying rinse to the space inside the screw adjacent to the surface 36 of intake space 32 that faces away from the suspension intake. This space has small access bores inside the core of the screw, through which the rinse arrives in the centrifuge's separation space, specifically in the conical section of the bowl, where it rinses out the solids.

Structure 16 compensates temperature-dictated changes in dimension and is radially resilient. When, specifically, the surface of the end 34 of intake pipe 31, which expands more extensively when heated, or, with reference to FIG. 1, the diameter of bolt 35 expands subject to heat, the ceramic bearing half, which expands much less at that temperature, will be subjected to tension, to which the ceramic material is sensitive. The tubular compensation structure has an inherently undulating surface, specifically with undulations extending either along the circumference or axially, as illustrated in the drawing. The radially outer bearing half is secured, depending on the embodiment, either to the inner surface of the end 34 of intake pipe 31 or to the surface 36 or 43 (FIG. 5) of the main section of the screw by heating it before bearing half 15 is inserted. When the structure cools, the different heat-expansion coefficients of the intake pipe or of the wall of the main section of the screw, steel for example, and of the ceramic structure, shrink the bearing half into position and compress it, to which the ceramic material is insensitive.

Rinse is supplied to the embodiment illustrated in FIG. 4 through a rinse-supply pipe 40 that is inherently rigid and functions as a connection between friction bearing 12 and the end 34 of intake pipe 31, whereby the inner surface of end 34 is supported on radial webs 42 on the outer surface of rinse-supply pipe 40. The supporting action occurs in the vicinity of friction bearing 12, which is positioned where rinse-supply pipe 40 extends through the face-demarcating surface 36 of intake space 32 that faces away from the intake end. Outer bearing half 15 also rests against the inner surface of a matching bore in the partition, whereas inner bearing half 14 rests against the outer surface of rinse-supply pipe 40. Friction bearing 12 accordingly constitutes a seal between the space that the rinse is introduced into and the intake space 32, into the end of which intake pipe 31 opens.

The embodiment illustrated in FIG. 5 on the other hand also features a very simple method of supplying suspension but without emergency lubrication or rinse. In this case, friction bearing 12 is positioned where intake pipe 31 extends through the partition 43 at the end of the intake space 32 inside the screw that faces the suspension intake. The outer half of friction bearing 12 rests against the inner surface of a matching bore in partition 43, whereas inner bearing half 14 engages the outer surface of intake pipe 31.

I claim:

1. A solid-bowl helical centrifuge, particularly a counter-flow centrifuge, for separating a suspension; comprising: a bowl and a feed screw, a separation space being left between said screw and said bowl; a stationarily secured intake pipe for supplying the suspension from a stationary infeed point outside the centrifuge to said separation space; said intake pipe extending into an intake space inside said screw; said intake pipe having an end in said intake space and resting against a component secured to said screw; a friction bearing with two halves made of ceramic material where said two halves contact each other, said component being secured to said screw by said friction bearing.

2. A centrifuge as defined in claim 1, wherein said ceramic material of said friction bearing is an oxide-free ceramic selected from one of silicon carbide and a ceramic based thereon.

3. A centrifuge as defined in claim 1, wherein said two halves of said friction bearing comprises one outer bearing half with a heat-shrunk outer surface.

4. A centrifuge as defined in claim 3, including temperature-stress means, said component having an outer surface, one of said two halves of said friction bearing comprising a radially inner bearing half secured with an inner surface to a section of said outer surface of said component by said temperature-stress compensation means.

5. A centrifuge as defined in claim 4, wherein said temperature-compensation means comprises a radially resilient ring member with an undulating surface.

6. A centrifuge as defined in claim 1, including a hydrodynamic film of lubricant, said bearing halves sliding against each other in presence of a liquid medium, said film lubricant being between said surfaces of said bearing halves sliding against each other.

7. A centrifuge as defined in claim 6, wherein said friction bearing communicates with the inside of said intake pipe, said suspension entering said separation space inside said centrifuge through said intake pipe, said friction bearing being lubricated by said suspension entering said separation space.

8. A centrifuge as defined in claim 6, including a backup liquid supplied automatically for lubricating said friction bearing when supply of said suspension is interrupted.

9. A centrifuge as defined in claim 6, including a separate pipeline for supplying lubricant to said friction bearing.

10. A centrifuge as defined in claim 6, including at least one temperature sensor in vicinity of said friction bearing for automatically initiating a lubricant supply to said friction bearing and stopping said centrifuge when temperature of said friction bearing exceeds a predetermined threshold.

11. A centrifuge as defined in claim 1, wherein said centrifuge has a conical section, said screw having a main section in said conical section and having a hollow space for introducing rinse, said main section of said screw being rotatable, said rinse having a stationary supply, said friction bearing being positioned in a seal at a transition between said stationary supply of said rinse and said rotatable main section of said screw.

12. A centrifuge as defined in claim 1, including a rinse-supply pipe positioned on said friction bearing in form of a stationary pipe in said screw along with said halves of said bearing, said intake pipe resting against said rinse-supply pipe.

13. A centrifuge as defined in claim 1, including a partition of said intake space facing said stationary infeed point, said intake pipe resting against said friction bearing in said partition.

* * * * *